US007624800B2

(12) United States Patent
Jamieson et al.

(10) Patent No.: US 7,624,800 B2
(45) Date of Patent: Dec. 1, 2009

(54) SYSTEM AND METHOD FOR SENSING PARAMETERS IN A WELLBORE

(75) Inventors: Donald Jamieson, Aberdeenshire (GB); Arthur Watson, Sugar Land, TX (US); John Booker, Aberdeen (GB); Kenneth Armstrong, Aberdeen (GB); Adrian Carr, North Yorkshire (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 240 days.

(21) Appl. No.: 11/164,428

(22) Filed: Nov. 22, 2005

(65) Prior Publication Data

US 2007/0114040 A1 May 24, 2007

(51) Int. Cl.
*E21B 43/12* (2006.01)

(52) U.S. Cl. ..... 166/250.01; 166/66; 166/68

(58) Field of Classification Search ..... 166/250.01, 166/380, 66, 68, 106
See application file for complete search history.

(56) References Cited

U.S. PATENT DOCUMENTS

| | | | | |
|---|---|---|---|---|
| 3,568,771 | A | 3/1971 | Vincent | |
| 4,492,523 | A * | 1/1985 | Knox | 417/13 |
| 4,581,613 | A | 4/1986 | Ward | |
| 4,583,923 | A * | 4/1986 | James | 417/414 |
| 4,741,208 | A * | 5/1988 | Vandevier | 73/152.51 |
| 6,119,780 | A | 9/2000 | Christmas | |
| 6,167,965 | B1 * | 1/2001 | Bearden et al. | 166/250.15 |
| 6,347,666 | B1 * | 2/2002 | Langseth | 166/252.1 |
| 6,585,041 | B2 | 7/2003 | Crossley | |
| 6,599,091 | B2 * | 7/2003 | Nagle | 415/229 |
| 6,695,052 | B2 | 2/2004 | Branstetter | |
| 6,811,382 | B2 * | 11/2004 | Buchanan et al. | 417/244 |
| 7,009,707 | B2 * | 3/2006 | Beresford et al. | 356/478 |
| 7,114,557 | B2 * | 10/2006 | Cudmore et al. | 166/52 |
| 2004/0256100 | A1 | 12/2004 | Tubel | |

FOREIGN PATENT DOCUMENTS

| | | |
|---|---|---|
| EP | 0465543 | 6/1995 |
| EP | 0465543 B1 | 6/1995 |
| EP | 1166428 | 12/2004 |
| EP | 1166428 B1 | 12/2004 |
| GB | 2151047 | 7/1985 |
| RU | 2050472 | 12/1995 |
| RU | 2057907 | 4/1996 |
| RU | 2140523 | 10/1999 |
| RU | 2237807 | 10/2004 |
| RU | 2250357 | 12/2004 |
| RU | 2256065 | 7/2005 |
| RU | 44349 | 10/2005 |
| RU | 2262079 | 10/2005 |
| SU | 1643794 | 5/1988 |

* cited by examiner

*Primary Examiner*—Kenneth Thompson
(74) *Attorney, Agent, or Firm*—Kevin B. McGoff; James L. Kurka

(57) ABSTRACT

A system and method is provided for sensing parameters within a wellbore. At least one sensor sub is coupled between stage components of an electric submersible pumping system. A plurality of sensor subs can be disposed between adjacent pairs of stage components to obtain sensor data along the electric submersible pump string. Each sensor sub contains a sensor element or elements designed to sense parameters internal and/or external to the electric submersible pumping system.

24 Claims, 2 Drawing Sheets

SYSTEM AND METHOD FOR SENSING PARAMETERS IN A WELLBORE

BACKGROUND OF THE INVENTION

1. Field of the Invention

The present invention generally relates to a system and methodology for sensing parameters in a wellbore. The parameters can be sensed internally and/or externally of an electric submersible pumping system deployed within the wellbore.

2. Description of Related Art

An electric submersible pumping system generally is formed as an electric submersible pump string having at least three main component sections. The sections comprise three-phase motor stages, pump stages, and motor protector stages generally located between the motor stages and the pump stages. In a typical arrangement, the motor stages are located below the pump stages within the wellbore. Historically, measurement of parameters within the well was constrained to sensors located below the motor stages and above the pump stages. For example, certain existing electric submersible pump string sensor systems utilize a sensing unit connected at the bottom of the submersible motor.

Attempts have been made to collect data from locations along the electric submersible pump string on various parameters. For example, a complete transducer has been attached to the side of the pump string by clamps or gauge carriers. In other attempts, a pressure line has been routed from a location along the pump string to a pressure sensor in a unit mounted below the motor. Also, sensors have been attached to the outside of the pump string and coupled to a dedicated electrical or fiber optic line run from a surface location. However, none of these approaches has succeeded in providing a rugged system of sensors for integration into an electric submersible pump string.

BRIEF SUMMARY OF THE INVENTION

In general, the present invention provides a system and methodology for sensing various parameters within a wellbore. The system utilizes one or more sensor subs designed for integrated coupling between stages of an electric submersible pumping system. Each sensor sub is coupled in line with the electric submersible pump string and is connected to ends of the adjacent pump string stages. Each sensor sub can be used to sense parameters internal and/or external to the electric submersible pump string.

BRIEF DESCRIPTION OF THE DRAWINGS

Certain embodiments of the invention will hereafter be described with reference to the accompanying drawings, wherein like reference numerals denote like elements, and.

DETAILED DESCRIPTION OF THE INVENTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and methodology for sensing well-related parameters. The parameters sensed can be parameters internal to the electric submersible pumping system, on the shaft/coupling, and/or parameters external to the pumping system. Furthermore, the present invention generally provides a system and methodology that facilitates positioning of sensing elements by incorporating small sensor subs between different component stages of an electric submersible pumping string. The sensor subs have integrated electronics and sensing element or elements that can be arranged to have access to external and/or internal portions of the electric submersible pumping system.

As explained more fully below, each sensor sub uses the standard profile and flange connections of the electric submersible pumping system component stages. This enables measurements of desired parameters to be acquired between any set of stages. For example, parameters may be sensed between two submersible motor stages, between submersible motor and motor protector stages, between two motor protector stages, between motor protector and pump intake stages, between pump intake and submersible pump stages, between two submersible pump stages, between submersible pump and discharge head stages, or between other types of component stages that may be used in the pump string.

The ability to install sensor subs between component stages enables the installation of a plurality of sensors at multiple longitudinal locations along the length of a given electric submersible pump string. The multiple sensor subs can be used to obtain a distributed set of measurements, e.g. temperature, vibration, or pressure measurements, along the pump string. The distributed set of measurements enables the monitoring of performance along the different stages of the electric submersible pumping system.

Figure 1:
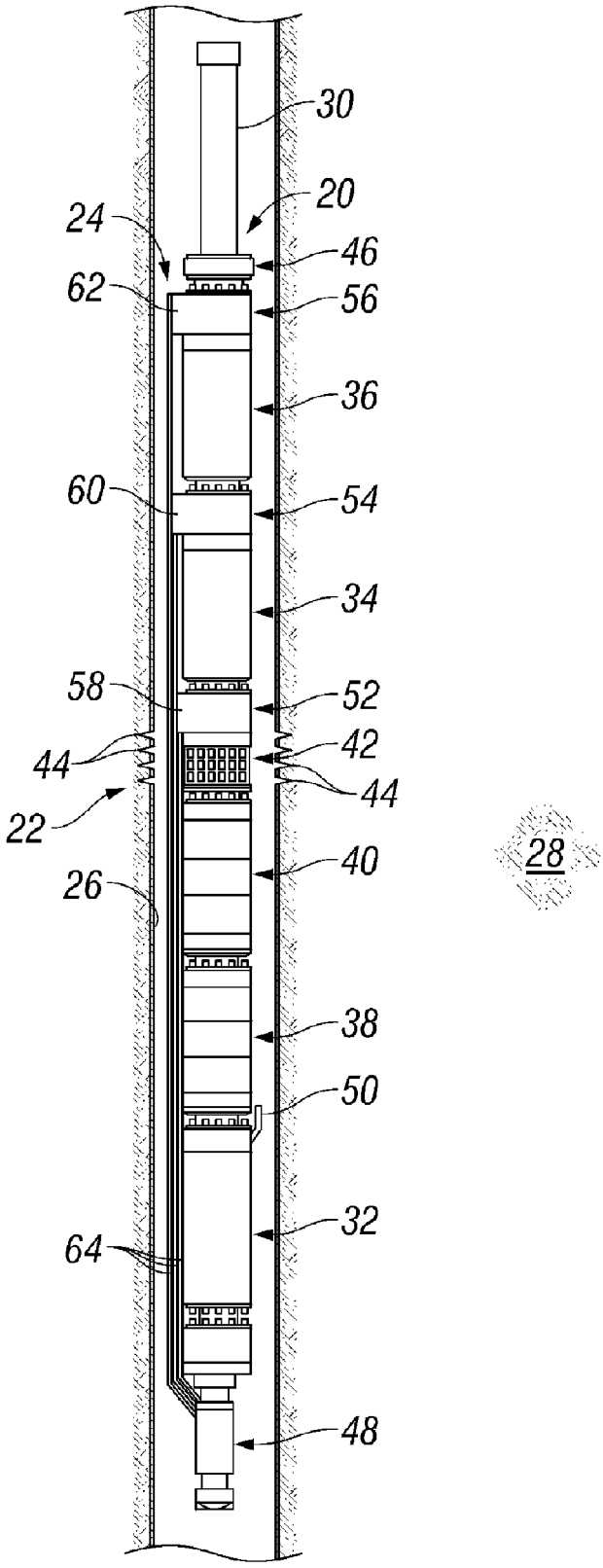
FIG. 1 is a front elevation view of an electric submersible pumping system deployed in a wellbore, according to an embodiment of the present invention.

Although the sensor subs can be installed into a variety of electric submersible pumping systems, a single embodiment is illustrated in FIG. 1 to provide an example and to further an understanding of the many systems and methodologies that can benefit from the use of the sensor subs. Accordingly, the reader should recognize that the sensor subs can be installed in electric submersible pump strings having, for example, a variety of additional component stages, fewer component stages, different component stages, and different arrangements of component stages. Referring generally to FIG. 1, an electric submersible pumping system 20 is illustrated as deployed for use in a well 22 having a wellbore 24 lined with a wellbore casing 26. Wellbore 24 is formed in a formation 28 that may contain, for example, desirable fluids, such as oil or gas. Electric submersible pumping system 20 is located within the interior of casing 26 and is deployed on a tubing 30, such as production tubing or coiled tubing. In some embodiments, tubing 30 is used as a conduit for carrying produced fluids, e.g. oil, from electric submersible pumping system 20 to a desired collection location.

In the embodiment illustrated, electric submersible pumping system 20 comprises a variety of component stages. Examples of the component stages comprise a submersible motor 32 operatively coupled to submersible pumps 34 and 36. Between submersible motor 32 and submersible pumps 34, 36 are a pair of motor protectors 38 and 40. Additionally, a pump intake 42 is positioned between motor protector 40 and submersible pump 34. Pump intake 42 enables electric submersible pumping system 20 to draw in well fluid, e.g. oil, from formation 28, through a plurality of perforations 44 formed in wellbore casing 26. The fluid is pulled into wellbore 24 and subsequently into submersible pumps 34 and 36 for production through tubing 30.

In the illustrated example, electric submersible pumping system 20 also comprises a discharge head 46, through which fluid is discharged from submersible pump 36 into tubing 30. The system also may comprise a base unit 48 connected below the submersible motor 32. Base unit 48 can be used to communicate information from the wellbore to the surface. In one embodiment, base unit 48 uses a power cable 50 as the communication line for transferring data to the surface. Power cable 50 is electrically connected to the submersible motor or motors, e.g. submersible motor 32, to power the motor and thereby power the electric submersible pumping system 20.

At least one sensor sub and often a plurality of sensor subs are connected into electric submersible pumping system 20 between ends of adjacent component stages. In the embodiment of FIG. 1, three sensor subs 52, 54, and 56 are illustrated for purposes of explanation. In this example, sensor sub 52 is connected between pump intake 42 and submersible pump 34; sensor sub 54 is connected between submersible pump 34 and submersible pump 36; and sensor sub 56 is connected between submersible pump 36 and discharge head 46. However, other numbers of sensor subs may be used, and the sensor subs can be located between different component stages of the electric submersible pumping system depending on the application in which the sensor subs are employed. In the system illustrated, sensor subs 52, 54, and 56 are deployed at selected locations 58, 60, and 62 along the pump string to provide a distributed set of measurements. For example, the sensor subs can be spaced along the submersible pumps to enable an operator to obtain a distributed set of measurements related to pump system performance along the different pump stages.

The sensor subs can be designed to utilize various methods for communicating data related to sensed parameters to desired collection locations, such as a surface control system. For example, the sensor subs can be coupled to base unit 48 by dedicated communication lines 64 that are used to carry power and communication data. Physical communication lines 64 also can be replaced with wireless communication lines. If a wireless system is utilized, the sensor subs can be powered by, for example, an internal battery or by incorporating a small generator powered by the rotating shaft of the electric submersible pumping system. As discussed above, the power cable 50 can be utilized by base unit 48 to transmit signals received from the sensor subs to a surface location. Depending on a variety of factors, such as the potential baud rate for communicating data along the power cable, the base unit 48 may transmit sensor data immediately upon receipt or it may acquire several measurements from each sensor sub before transmitting the sensor data to the surface or other data collection location. The actual methodology for transferring data can be selected according to the application, environment, and components available/utilized for a given project.

Figure 2:
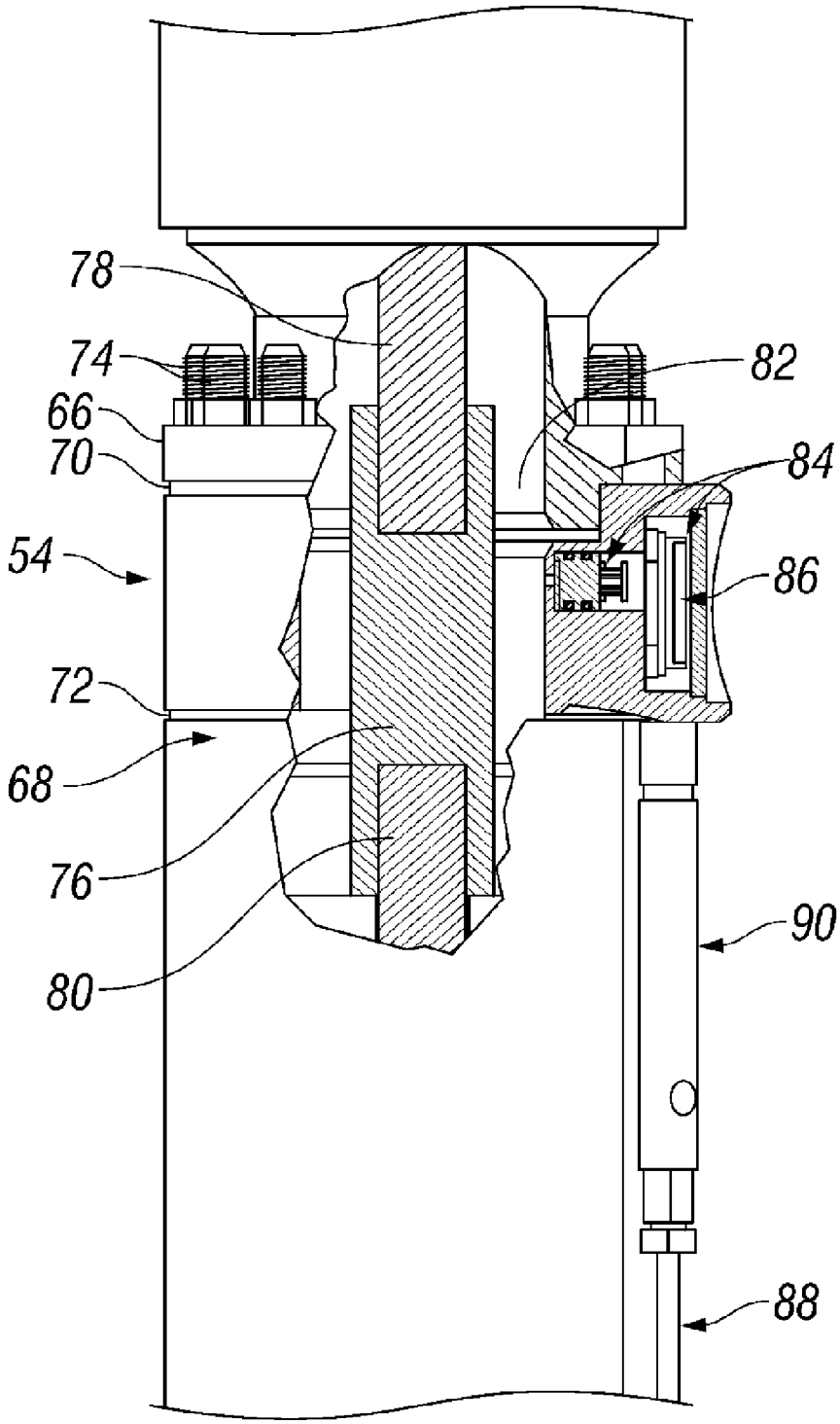
FIG. 2 is a front elevation view with a partial cut-away section of a sensor sub coupled between stages of an electric submersible pumping system, according to an embodiment of the present invention.

As illustrated, sensor subs 52, 54, and 56 are coupled in longitudinal, e.g. axial, alignment with the component stages of the electric submersible pumping system 20. The sensor subs are disposed between ends 66, 68 of sequential component stages, as further illustrated in FIG. 2. In this embodiment, sensor sub 54 is used as an example, but the explanation also applies to sensor subs 52 and 56, as well as other sensor subs that may be used between other component stages.

In this embodiment, each sensor sub utilizes a standard profile and flange connection of the electric submersible pumping system component stages. As illustrated, the sensor sub, e.g. sensor sub 54, has a pair of opposed standard sealing faces 70 and 72 designed for engagement with component stage ends 66 and 68, respectively. The sensor sub 54 is captured between component stage ends 66 and 68 by a plurality of threaded fasteners 74, such as threaded studs or bolts, that extend longitudinally through the sensor sub. Alternatively, threaded fasteners 74 may be integral with sensor sub 54. In many applications, the sensor sub can be mounted between adjacent component stages by simply using longer bolts or longer threaded studs to replace those that conventionally connect electric submersible pumping system stage components. An extended coupling 76 is used to drivingly couple sequential shaft sections 78 and 80 of sequential component stages connected to opposed ends of the sensor sub. Extended coupling 76 rotates within a generally central opening 82 disposed longitudinally through the sensor sub 54.

Each sensor sub further comprises a sensor or sensors 84 designed to sense one or more well-related parameters. For example, sensors 84 may have sensing elements designed to detect and/or measure a variety of parameters internal to the electric submersible pumping system 20 and/or a variety of parameters external to the electric submersible pumping system 20. The sensors designed to measure internal parameters can be designed to measure, for example, internal pressure, internal temperature, vibration, torque through coupling 76, rotational speed, and/or stress on system components. In some applications, sensing elements can be placed on coupling 76 to facilitate the measurement of certain internal parameters, such as torque and rotational speed. A variety of parameters external to the electric submersible pumping system 20 can also be sensed by appropriate sensors 84. Examples of these external parameters include external pressure and temperature, and chemical measurements, such as for scale and hydrogen sulfide detection. The positioning of multiple sensor subs can be used to obtain distributed sets of measurements for a variety of these parameters, including internal/external temperature and pressure.

The data collected by sensors 84 is processed by appropriate electronics 86, the design of which depends on the specific types of sensors utilized, as well as the parameters to be sensed. The electronics 86 output data collected by sensors 84 to, for example, base unit 48 for further transfer to a desired surface or other location. In the sample illustrated in FIG. 2, data is output through a cable 88 coupled to the sensor sub by a cable head 90. It should be noted, however, component 90 also may be designed as a transponder for outputting data wirelessly to the base unit 48 or to other data collection devices.

Accordingly, sensor subs, such as sensor subs 52, 54, and 56, can be integrated into a variety of electric submersible pump strings directly in line with the system component stages. The sensor subs are readily coupled between multiple types and arrangements of stages to facilitate the gathering of data at many locations along the pump string. The ability to securely and integrally incorporate sensor subs at multiple desired locations along the pump string further enables the electric submersible pumping system designer to design systems for obtaining distributed sets of measurements of one or more parameters of interest, whether those parameters be internal to the system or external to the system.

Although, only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for sensing wellbore parameters, comprsing:

an electric submersible pumping system having a plurality of component stages including at least a submersible motor, a motor protector, a submersible pump; and at least one sensor sub;

the at least one sensor sub being coupled between adjacent ends of a pair of the component stages, the at least one sensor sub having a sensor to sense a desired wellbore parameter external to the least one sensor sub, an opening extending through the sensor sub;

a first shaft mechanically connected with one of the adjacent component stages, a second shaft mechanically connected with another of the adjacent component stages, each of the first shaft and the second shaft being rotatable with respect to the respective component stage, and a coupling rotationally coupling the first shaft with the second shaft and being located in the opening extending through the sensor sub.

2. The system as recited in claim 1, wherein the desired wellbore parameter comprising temperature.

3. The system as recited in claim 1, wherein the desired wellbore parameter comprising pressure.

4. The system as recited in claim 1, wherein the desired wellbore parameter comprises scale.

5. The system as recited in claim 1, wherein the desired wellbore parameter comprises hydrogen sulfide.

6. The system as recited in claim 1, wherein the at least one sensor sub has a sensor selected to obtain a distributed set of parameter measurements along the electric submersible pumping system.

7. A device for sensing wellbore parameters, comprising:

at least one sensor sub, comprising:

a housing having a pair of opposed standard sealing faces for coupling two component stages of an electric submersible pumping system, and an opening extending axially through the sensor sub connecting the opposed standard sealing faces;

at least one sensor mounted in the housing, the at least one sensor comprising a sensor to sense a desired wellbore parameter external to the housing;

a mechanism for conveying sensor data from the at least one sensor sub;

a coupling located in the opening extending axially through the sensor sub, the coupling being rotatable inside the opening, each end of the coupling being adapted to rotationally couple with a first shaft and a second shaft to transmit rotational power therebetween.

8. The device as recited in claim 7, wherein the at least one sensor comprises another sensor to sense a parameter internal to the electric submersible pumping system.

9. The device as recited in claim 7, wherein the pair of opposed standard sealing faces are coupled to the component stages with a plurality of threaded fasteners generally aligned with the electric submersible pumping system in a longitudinal direction.

10. The device as recited in claim 9, wherein the plurality of threaded fasteners comprises individual threaded fasteners having sufficient length to extend through the housing to engage the component stages on both sides of the standard sealing faces.

11. The device as recited in claim 9, wherein the plurality of threaded fasteners are integral with the sensor sub.

12. The device as recited in claim 7, wherein the opening to accommodate the shaft coupling is central in the housing.

13. The device as recited in claim 7, wherein the mechanism comprises a cable head and a cable for conveying signals.

14. The device as recited in claim 7, wherein the mechanism comprises a wireless transponder for conveying signals.

15. The device as recited in claim 7, wherein the device is powered by a rotating shaft of the electric submersible pumping system.

16. A method, comprising:

assembling an electric submersible pumping system with a plurality of stage components comprising at least a submersible pump, a submersible motor and a motor protector;

coupling a sensor sub longitudinally between adjacent ends of sequential stage components;

rotationally coupling a shaft of one of the adjacent stage component to a shaft of the other adjacent stage component by way of a shaft coupling that extends through the sensor sub and can rotate within the sensor sub; and outputting sensor data from the sensor sub to a base unit below the submersible motor.

17. The method as recited in claim 16, wherein coupling comprises connecting each sensor sub to adjacent stage components with a pair of opposed standard sealing faces.

18. The method as recited in claim 16, further comprising sensing a parameter external to the electric submersible pumping system.

19. The method as recited in claim 16, further comprising sensing a parameter internal to the electric submersible pumping system.

20. A method, comprising:

assembling an electric submersible pumping system with a plurality of stage components comprising at least a submersible pump, a submersible motor and a motor protector;

coupling a sensor sub longitudinally between adjacent ends of sequential stage components, the sensor sub being part of a plurality of a sensor subs;

rotationally coupling a shaft of one of the adjacent stage component to a shaft of the other adjacent stage component by way of a shaft coupling that extends through the sensor sub and can rotate within the sensor sub; and utilizing the plurality of sensor subs to obtain a distributed set of measurements along the electric submersible pumping system.

21. The method as recited in claim 20, further comprising sensing a parameter external to the electric submersible pumping system.

22. The method as recited in claim 20, further comprising sensing a parameter internal to the electric submersible pumping system.

23. The method as recited in claim 20, further comprising outputting sensor data from the at least one sensor sub to a base unit below the submersible motor.

24. A system for sensing wellbore parameters, comprsing:

an electric submersible pumping system having a plurality of component stages including at least a submersible motor, a motor protector, a submersible pump; and at least one sensor sub;

the at least one sensor sub being coupled between adjacent ends of a pair of the component stages, the at least one sensor sub having a sensor to sense a desired parameter, an opening extending through the sensor sub;

a first shaft mechanically connected with one of the adjacent component stages, a second shaft mechanically connected with another of the adjacent component stages, each of the first shaft and the second shaft being rotatable with respect to the respective component stage, and a coupling rotationally coupling the first shaft with the second shaft and being located in the opening extending through the sensor sub wherein the system is powered by a rotating shaft of the electric submersible pumping system.

* * * * *